US006412930B1

(12) United States Patent
Studholme

(10) Patent No.: US 6,412,930 B1
(45) Date of Patent: Jul. 2, 2002

(54) CARTRIDGE HAVING REMOVABLE PART FOR OPENING AN APERTURE

(75) Inventor: William J. Studholme, Boston (GB)

(73) Assignee: Dynamic Cassette International Ltd., Lincolnshire (GB)

( * ) Notice: Subject to any disclaimer, the term of this patent is extended or adjusted under 35 U.S.C. 154(b) by 0 days.

(21) Appl. No.: 09/495,435

(22) Filed: Jan. 31, 2000

(30) Foreign Application Priority Data

Jan. 30, 1999 (GB) ..... 9901995
Mar. 1, 1999 (GB) ..... 9904498

(51) Int. Cl.[7] ..... B41J 2/175

(52) U.S. Cl. ..... 347/86; 222/325; 222/153.06; 222/482

(58) Field of Search ..... 347/85, 86, 87; 222/325, 153.04, 153.06, 482; 399/262, 238

(56) References Cited

U.S. PATENT DOCUMENTS 4,970,533 A * 11/1990 Saito et al. ..... 347/86
5,671,000 A * 9/1997 Hirabayashi et al. ..... 347/86
5,847,735 A * 12/1998 Betschon ..... 347/86

FOREIGN PATENT DOCUMENTS

JP 6-171100 A * 6/1994 ..... B41J/2/175
JP 10-67118 * 3/1998 ..... B41J/2/175

* cited by examiner

*Primary Examiner*—David F. Yockey
(74) *Attorney, Agent, or Firm*—Kilpatrick Stockton LLP

(57) ABSTRACT

A cartridge 10 for a printer 40, the cartridge 10 including a rigid element 32 which protrudes from the remainder of the cartridge 10 for preventing the cartridge 10 from being filly engaged in the printer 40. The main part 34 of the element 32 is arranged to be removed by snapping it off to enable the cartridge 10 to be fully engaged in a printer 40 and to open at least one aperture into the cartridge.

26 Claims, 4 Drawing Sheets

CARTRIDGE HAVING REMOVABLE PART FOR OPENING AN APERTURE

FIELD OF THE INVENTION

The invention relates to a cartridge and the combination of a cartridge and a printer.

Ink cartridges for printers such as ink jet printers include a delivery aperture, through which ink is withdrawn for printing and one or more breather holes, through which air enters to replace the volume of ink withdrawn, and to prevent a vacuum being created in the cartridge as a result of withdrawal of ink. Cartridges are commonly supplied with a seal over the delivery aperture and a label over the breather hole or holes to prevent the cartridges from leaking in handling before they are inserted into a printer. The seal is pierced by the ink withdrawal needle of the printer when the cartridge is inserted. The label however must be removed before the cartridge is inserted into the printer or ink cannot be withdrawn. This is particularly important in the first use of a printer of the kind where ink is transferred through a pipe from the cartridge to a remote printing head. At its first use, the printer is empty of ink and attempts to draw sufficient ink from the cartridge to fill the pipe and hence reach the printing head. If there is a label still over the breather hole or holes, this will be resisted due to vacuum build-up in the cartridge and the printer can be damaged.

SUMMARY OF THE INVENTION

According to one aspect of the invention there is provided the combination of a cartridge and a printer, the cartridge including an element preventing the cartridge from being fully engaged in the printer, at least part of the element being arranged to be removed to enable the cartridge to be fully engaged in the printer and to open at least one aperture into the cartridge.

The element may be a protruding element and may be rigid. The removal may be by snapping or breaking off at least part of the element.

According to another aspect of the invention there is provided a cartridge for a printer, the cartridge including a rigid element at least part of which is arranged to be removed to open at least one aperture into the cartridge.

According to a further aspect of the invention, there is provided a cartridge for a printer, the cartridge including an element at least part of which is arranged to be removed by being snapped off to open at least one aperture into the cartridge.

According to another aspect of the invention there is provided a cartridge for a printer, the cartridge including an element at least part of which is arranged to be removed by being broken off to open at least one aperture into the cartridge.

Preferably, the element is protruding.

The or each aperture may be a delivery aperture. In a preferred embodiment the or each aperture is a breather hole.

The element may include a connecting part which is connected to the cartridge, the connecting part including at least one projection, the or each projection being received in an aperture of the cartridge. The element may be arranged to be removed so that the or each projection is removed from the or each aperture, but preferably a removable part of the element is removable from the connecting part, and preferably further the or each projection defines a passageway into the aperture so that when the removable part has been removed there is a passageway defined into the cartridge.

The or each projection and the or each aperture preferably have complementary surfaces. This increases the surface area of contact and therefore increases the frictional force to ensure that the connecting part is not removed by removal of the removable part. The or each projection and the or each aperture may have polished contact surfaces. This further increases the surface area of contact to increase frictional force. The or each projection and the or each aperture are preferably tapered. In this way the or each projection can be jammed in the or each aperture achieving a tight fit. The taper may be less than 5° and preferably is about 1°.

The removable part of the element may extend substantially perpendicularly to the axis of the or each projection.

The removable part of the element may lie against a surface of the cartridge, which may be the surface in which the or each aperture is formed, and may extend beyond the surface as a protruding part. The protruding part may lie in a plane substantially perpendicular to the axis of the or each projection. Preferably the extended part extends downwardly from that plane towards the cartridge body. The removable part may include a portion which lies against a second surface of the cartridge. The second surface may be perpendicular to the first surface. The portion which lies against a second surface of the cartridge will act to resist movement in the direction towards the second surface and therefore ensure that removal takes place only in the opposite direction thereby ensuring removal in the desired manner. The removable part may include a portion which lies against a third surface of the cartridge which may be perpendicular to the first and/or second surfaces. The removable part preferably further includes a portion which lies against a fourth surface of the cartridge which may be parallel to one of the other surfaces. In this way, the removal can only take place in the desired direction, as movement in any other direction is resisted by one of the said portions.

BRIEF DESCRIPTION OF DESCRIPTION OF DRAWINGS

Three embodiments of the invention will now be described by way of example and with reference to the accompanying drawings, in which.

DETAILED DESCRIPTION OF PREFERRED EMBODIMENTS

Figure 1:
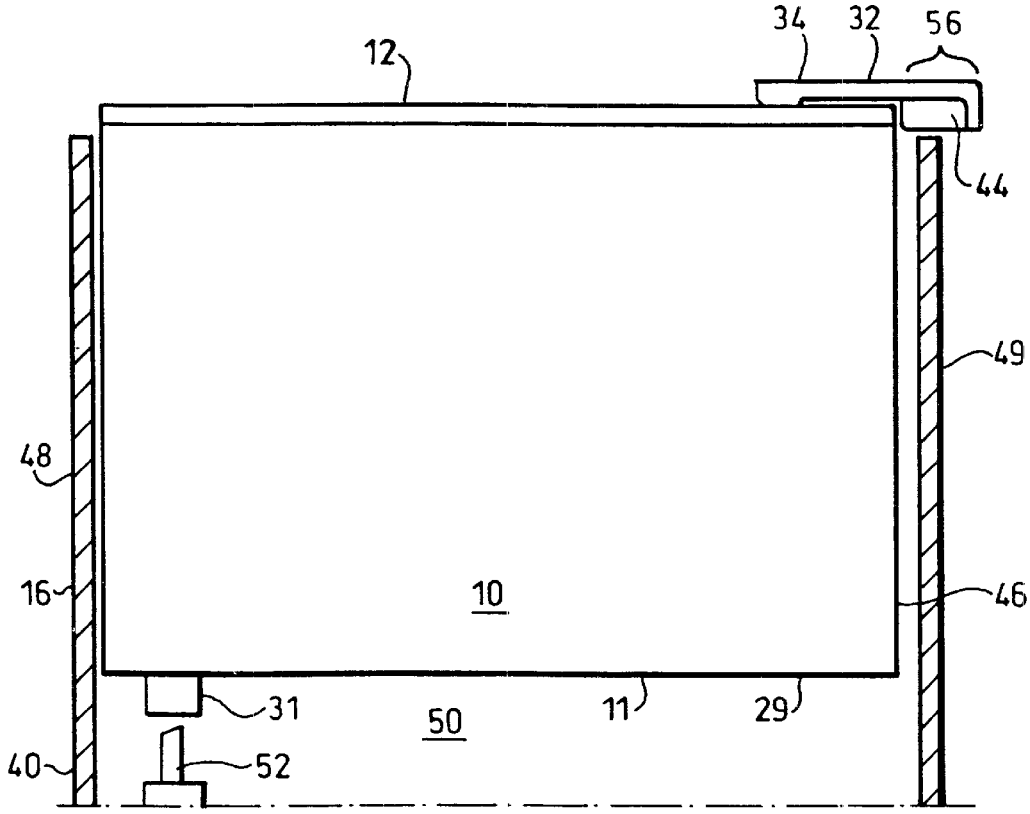
FIG. 1 is a side elevation of a cartridge in a first embodiment of the invention, the cartridge being partially inserted into a printer, only a fragment of the printer being shown, and that fragment in partial cross-section.
Figure 2:
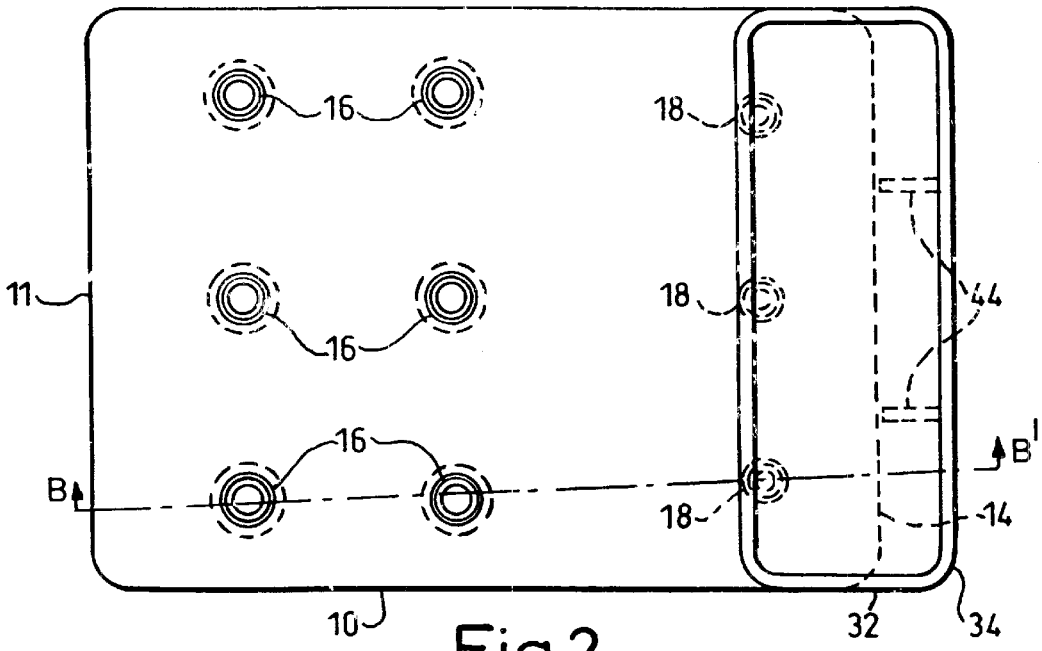
FIG. 2 is a top plan view of the cartridge of FIG. 1.
Figure 3:
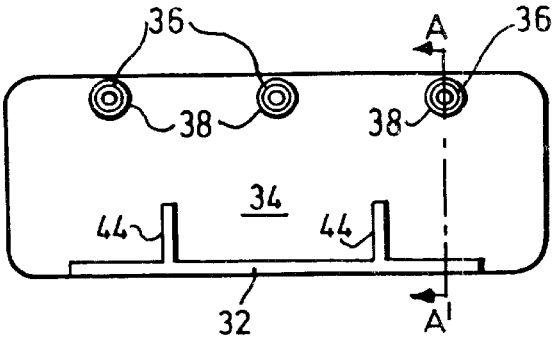
FIG. 3 is an underneath plan view of an element of the cartridge of FIG. 1.
Figure 6:
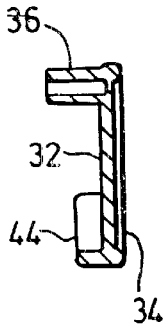
FIG. 6 is a side elevation in cross-section at A—A of FIG. 4.
Figure 4:
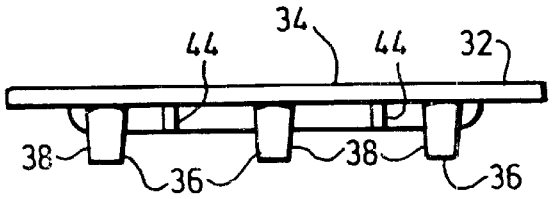
FIG. 4 is a rear elevation of the element of FIG. 3.
Figure 5:
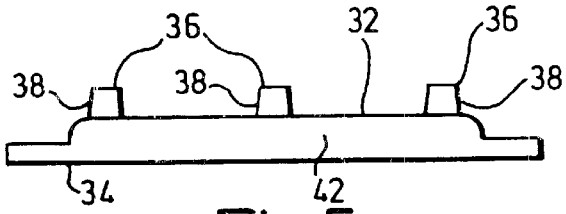
FIG. 5 is a front elevation of the element of FIG. 3.
Figure 7:
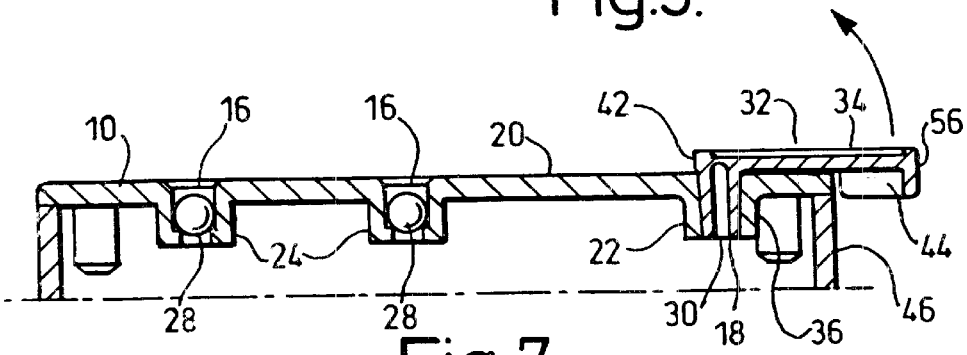
FIG. 7 is a detail side elevation of the top of the cartridge at B—B in FIG. 2.

The cartridge 10 of the first embodiment is a generally rectangular box 11 having a top 12. The cartridge 10 includes three breather holes 18 in the top 12 which are equally spaced along a notional line parallel to and adjacent the rear edge 14 of the cartridge 10. The top 12 further defines a plurality of fill holes 16.

The top 12 comprises a platelike main body 20 and a plurality of depending hollow bosses 22, 24, aligned with the breather holes 18 and the plurality of fill holes 16 respectively, the fill holes 16 being blocked by ball bearings 28. The breather holes 18 are axially elongate. The walls 30 defining each breather hole 18 are tapered inwardly downwardly at an angle of about 1° to the axis of the breather hole 18. The cartridge 10 is made of plastics material. The walls 30 of the breather holes 18 are polished. The cartridge box 11 includes a hollow boss defining an outlet port 31 depending from its bottom surface 29.

An element 32 comprises a main part 34 and three depending hollow projections 36 which are received in the breather holes 18. The projections 36 are of a complementary tapered shape to the breather holes 18 and have polished outer surfaces 38. The main part 34 is generally rectangular and tray shaped and lies over the upper surface of the top 12 extending rearwardly past the rear edge 14 of the top 12. The front edge 42 of the main part 34 terminates just past the forwardmost extent of the projections 36. The main part 34 is the same width as the top 12. Two ribs 44 depend from the main part 34 and extend in the front to rear direction of the cartridge 10. Each rib 44 terminates adjacent the rear wall 46 of the box 11.

A printer 40 includes walls 48, 49 defining an upwardly open cartridge receiving space 50. Extending upwardly into the bottom of the space 50 is an ink withdrawal needle 52 which is connected by a pipe (not shown) to a print head (not shown).

Figure 8:
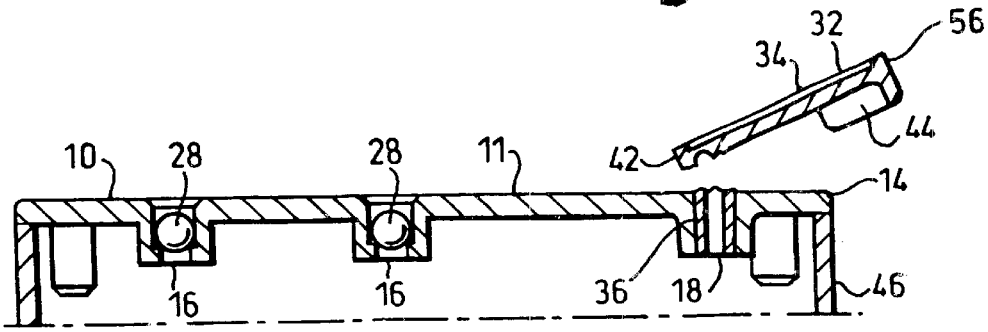
FIG. 8 is the view of FIG. 7 with part of the element broken away.
Figure 9:
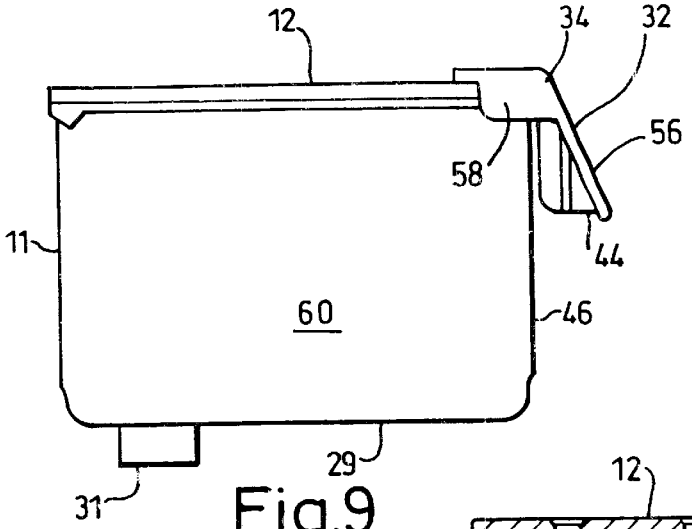
FIG. 9 is a side elevation of a cartridge in a second embodiment.
Figure 11:
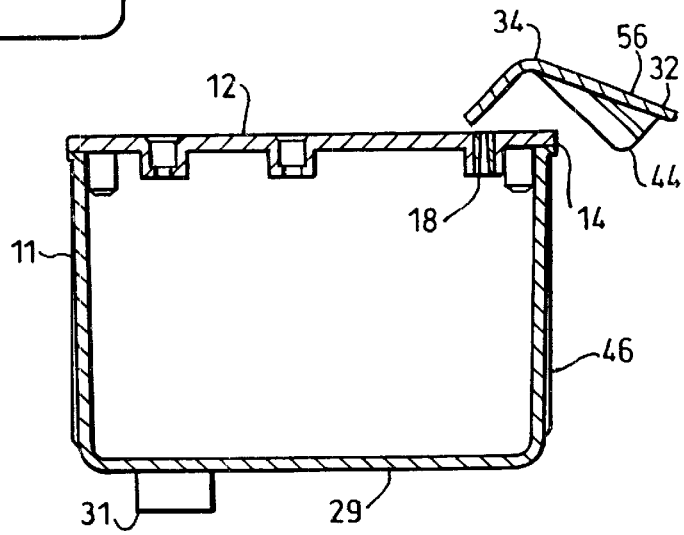
FIG. 11 is the view of FIG. 10 with part of an element of the cartridge broken away.
Figure 10:
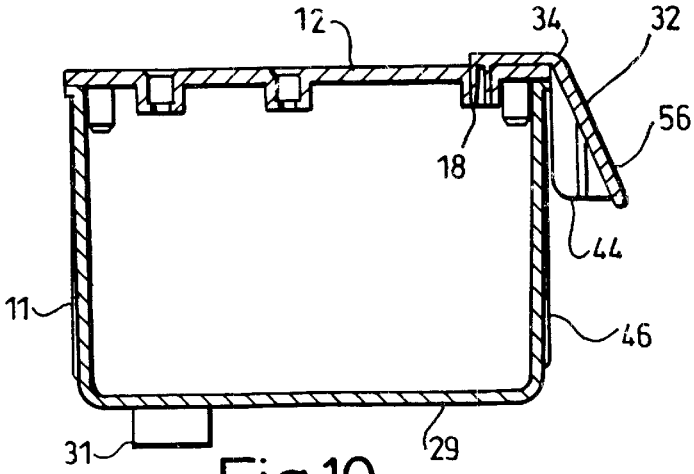
FIG. 10 is a side elevation in cross-section of the cartridge of FIG. 9.
Figure 12:
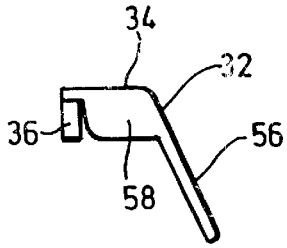
FIG. 12 is a side elevation of the element of the cartridge of the second embodiment.
Figure 13:
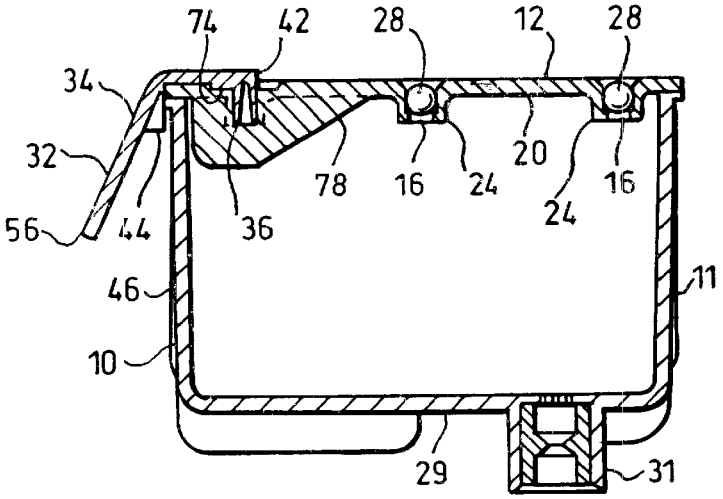
FIG. 13 is a side elevation in cross-section of a cartridge in a third embodiment.
Figure 15:
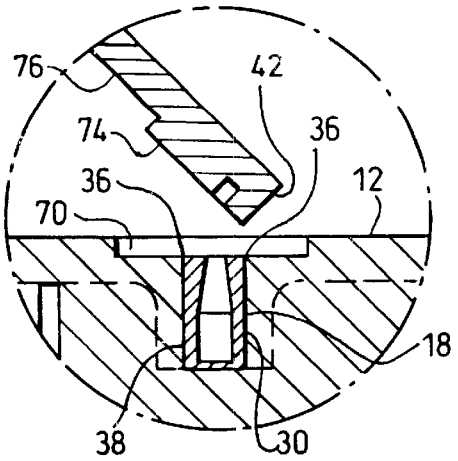
FIG. 15 is a fragmentary detail view of the break area of FIG. 14.
Figure 16:
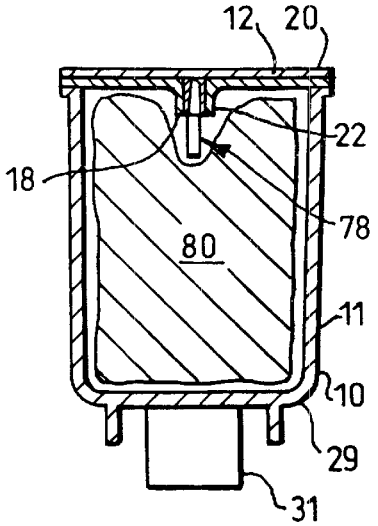
FIG. 16 is an end elevation in cross-section at C—C of FIG. 14.
Figure 14:
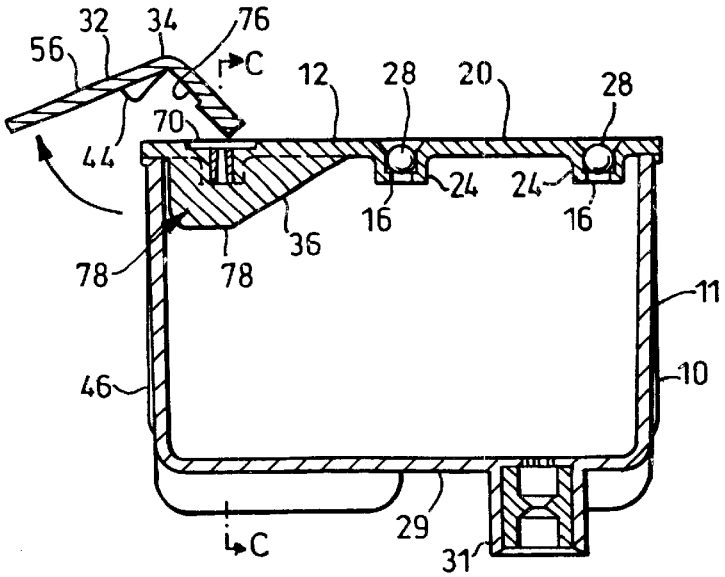
FIG. 14 is the view of FIG. 13 with part of an element of the cartridge broken away.

In use, the element 32 blocks the breather holes 18 as the main part 34 blocks the ends of the hollow projections 36 which are firmly engaged in the breather holes 18. If the cartridge 10 is lowered into the cartridge receiving space 50, the ribs 44 of the element 32 of the cartridge 10 will foul on the top of the rear wall 49 defining space 50 preventing the outlet port 31 of the cartridge 10 from receiving the withdrawal needle 52. If the cartridge 10 is removed, the protruding rear part 56 of the main part 34 can be grasped and lifted. As the projections 36 are frictionally held, the main part 34 will be broken away with a snap action by the lever force applied. The projections 36 will be left in the breather holes 18 as shown in FIG. 8 and are now unblocked as the result of removal of the main part 34 so that there is a clear passageway through each hollow projection 36 and breather hole 18 into the interior of the cartridge 10. The cartridge 10 can then be fitted in the printer 40 with the ink withdrawal needle 52 received in the outlet port 31 of the cartridge 10.

The polished outer surfaces 38 of the projections 36 and the walls 30 of the breather holes 18 and their tapered fit ensure that there is a strong frictional force holding the projections 36 into the breather holes 18.

The ribs 44 prevent the main part 34 being levered by the protruding rear part 56 in the downwards direction as shown in the drawings which otherwise would use the rear edge 14 of the top 12 as a fulcrum and the action would therefore tend to lever the projections 36 out of the breather holes 18. The ribs 44 resist movement in that direction and therefore ensure that the rear part 56 can only be moved in the opposite direction which is the correct direction to break the connection to the projections 36.

The second embodiment is shown in FIGS. 9 to 12. The second embodiment is similar to the first and only the differences from the first embodiment will be described. The same reference numerals will be used for equivalent features.

In the second embodiment the main part 34 is not tray-shaped and the protruding rear part 56 extends downwardly from the remainder of the main part 34 at the rear edge 14 of the top 12 of the cartridge box 11 at an angle of about 20° to the rear wall 46 of the cartridge box 11. The ribs 44 extend over the length of the rear part 56 and from the rear part 56 to the rear wall 46 of the box 11 and are thus triangular.

The element 32 further includes two flanges 58 provided on opposite sides of the main part 34. Each flange 58 depends from the main part 34 where it lies on the upper surface on the top 12 to closely lie adjacent a side surface 60 of the box 11, and is also connected to the side edge of the protruding part 56.

In use, the ribs 44 will prevent movement of the main part 34 in the direction towards the rear wall 46 of the box 11, as in the first embodiment. The flanges 58 will also prevent movement of the main part 34 about a longitudinal axis in the plane of the top surface of the top 12 of the box 11. The element 32 is thus confined to movement only about an axis parallel to the rear edge 14 of the box 11 and parallel to the line of breather holes 18. The fact that the protruding or extended rear part 56 is at an angle reduces the risk of the main part 34 being broken off accidentally, while at the same time giving better leverage and an easier manual action when the user does want to break off the main part 34. It also spaces the outlet port 31 of the cartridge further from the withdrawal needle 52 of the printer 40 on attempted entry of the cartridge 10 into the printer 40.

The third embodiment shown in FIGS. 13 to 16 will now be described. The third embodiment is similar to the second embodiment and only the differences from the second embodiment will be described. The same reference numerals will be used for equivalent features.

The top 12 of the cartridge 10 has only the central one of the three breather holes 18 of the other embodiments. The top 12 includes a shallow recess 70 in the upper surface 72 thereof around the breather hole 18. The main part 34 of the element 32 includes a raised land 74 on its underside 76 which is received in the recess 70.

A longitudinal rib 78 depends from the underside of the top 12 to lie within the cartridge 10 and extends from the rear wall 46 of the box 11 nearly to the nearest fill hole boss 24. The rib 78 intersects the boss 22 defining the breather hole 18 and there is a small gap in the rib 78 around the end of the breather hole 18 so that the passage of air through the breather hole 18 is not obstructed by the rib 78. The rib 78 is of substantially constant depth from the rear wall 46 to past the boss 22 and then steadily decreases in depth. A porous member 80 in the form of a sponge is provided in the box 11 in use and is impregnated with ink.

In use, the rib 78 keeps the ink impregnated sponge 80 away from the end of the breather hole 18 and this inhibits the entry of ink into the hollow projection 36 and the breather hole 18. It was found that without the rib 78 ink could be drawn into the hollow projection 36 and the breather hole 18 by capillary action and that removal of the main part 34 could lead to ink "spitting" out of the top of the breather hole 18.

If there should be any leakage of ink from the breather hole 18 then the recess 70 confines the leakage so that the chances of a person handling the cartridge 10 getting ink on their fingers is reduced.

What is claimed is:

1. A cartridge for a printer, the cartridge including at least one aperture and an element for preventing the cartridge from being fully engaged in the printer, a removable part of the element being operative for selectable removal to enable the cartridge to be fully engaged in a printer and to open at least one said aperture into the cartridge, the element including at least one projection, said at least one projection being received in at least one aperture of the cartridge to connect the element to the cartridge, each projection defining a hole which extends there into and terminates in a blind end in the removable part so that when the removable part has been removed the hole provides a passageway into the cartridge.

2. A cartridge as claimed in claim 1, wherein the element is rigid.

3. A cartridge as claimed in claim 1, wherein the element is protruding.

4. A cartridge as claimed in claim 1, wherein the aperture is a breather hole.

5. A cartridge as claimed in claim 1, wherein the element includes a connecting part which is connected to the cartridge.

6. A cartridge as claimed in claim 5, wherein the connecting part includes the at least one projection, each projection being received in a said aperture of the cartridge to connect the connecting part to the cartridge.

7. A cartridge as claimed in claim 1, wherein each projection and each aperture have complementary surfaces.

8. A cartridge as claimed in claim 7, wherein each projection and each aperture have polished contact surfaces.

9. A cartridge as claimed in claim 7, wherein each projection and each aperture are tapered.

10. A cartridge as claimed in claim 9, wherein the taper is less than 5°.

11. A cartridge as claimed in claim 9, wherein the taper is about 1°.

12. A cartridge as claimed in claim 1, wherein at least part of the removable part of the element extends substantially perpendicularly to an axis of each projection.

13. A cartridge as claimed in claim 1, wherein the surface in which each aperture is formed defines a recess around each aperture an least part of the removable part lies in the recess.

14. A cartridge as claimed in claim 1, wherein at least a portion of the removable part of the element lies adjacent a surface of the cartridge.

15. A cartridge as claimed in claim 14, wherein at least a portion of the removable part of the element lies adjacent the surface in which the or each aperture is formed.

16. A cartridge as claimed in claim 1, wherein the removable part includes a protruding part which extends beyond the surface in which each aperture is formed.

17. A cartridge as claimed in claim 16, wherein the protruding part lies in a plane substantially perpendicular to the axis of each projection.

18. A cartridge as claimed in claim 16, wherein the protruding part extends downwardly at an angle.

19. A cartridge as claimed in claim 16, wherein the removable part includes a portion which lies adjacent a second surface of the cartridge.

20. A cartridge as claimed in claim 19, wherein the second surface is perpendicular to the first surface.

21. A cartridge as claimed in claim 20, wherein the removable part includes a portion which lies adjacent a third surface of the cartridge.

22. A cartridge as claimed in claim 21, wherein the third surface is perpendicular to the first surface.

23. A cartridge as claimed in claim 22, wherein the fourth surface is parallel to the third surface.

24. A cartridge as claimed in claim 21, wherein the third surface is perpendicular to the second surface.

25. A cartridge as claimed in claim 21, wherein the removable part further includes a portion which lies adjacent a fourth surface of the cartridge.

26. A cartridge as claimed in claim 1, wherein an air gap is defined within the cartridge behind each aperture.

* * * * *